United States Patent [19]

Faber et al.

[11] Patent Number: 4,963,204

[45] Date of Patent: Oct. 16, 1990

[54] PYROTECHNIC DELAY COMPOSITIONS

[75] Inventors: Günther Faber, Siegburg; Hans Florin, Troisdorf; Peter-Josef Grommes, Troisdorf; Peter Röh, Troisdorf, all of Fed. Rep. of Germany

[73] Assignee: Dynamit Nobel Aktiengesellschaft, Troisdorf, Fed. Rep. of Germany

[21] Appl. No.: 320,772

[22] Filed: Mar. 8, 1989

[30] Foreign Application Priority Data

Mar. 12, 1988 [DE] Fed. Rep. of Germany ..... 3808366

[51] Int. Cl.[5] ..... C06B 33/12

[52] U.S. Cl. ..... 149/40

[58] Field of Search ..... 149/40

[56] References Cited

U.S. PATENT DOCUMENTS

| | | | |
|---|---|---|---|
| 3,028,229 | 4/1962 | Olander | 149/40 |
| 3,172,795 | 3/1965 | Heliwell et al. | 149/40 |
| 3,701,697 | 10/1972 | Zimmer-Galler et al. | 149/40 |
| 3,726,730 | 4/1973 | Rose | 149/40 |
| 4,239,004 | 12/1980 | Day et al. | 102/202.13 |
| 4,356,768 | 11/1982 | Cord et al. | 102/202.13 |
| 4,422,383 | 12/1983 | Couture et al. | 102/364 |

OTHER PUBLICATIONS

Hawley, "The Condensed Chemical Dictionary", 9th Ed., pp. 19, 773, 774, Van Nostrand Reinhold Co., (1977) New York.

*Primary Examiner*—Edward A. Miller
*Attorney, Agent, or Firm*—Felfe & Lynch

[57] ABSTRACT

Pyrotechnic delay compositions with delays in the seconds range are based on a pyrotechnic delay mixture of powdered metallic tungsten, barium chromate an potassium perchlorate, and additionally contain either barium hexafluorosilicate or calcium fluoride pyrogenic silica. The additives cause these compositions to burn completely even under severe environmental conditions, such as very fast rotation, vibration, impact, shock, and, at the same time, extremely low below-freezing temperatures. The effect of the barium hexafluorosilicate is still further improved if the delay compositions additionally contain pyrogenic silica.

4 Claims, No Drawings

PYROTECHNIC DELAY COMPOSITIONS

FIELD OF THE INVENTION

This invention relates to pyrotechnic delay compositions with delays in the order of seconds, which are composed of a pyrotechnic mixture of powdered metallic tungsten, barium chromate, potassium perchlorate, and barium hexafluorosilicate or calcium fluoride, combined with pyrogenic silica.

BACKGROUND OF THE INVENTION

It is known that pyrotechnic mixtures of tungsten, barium chromate and potassium perchlorate are used in delay compositions with long delays. Depending on the composition and grain size of the tungsten, delays between 0.1 and 2 seconds per millimeter of composition depth are achieved therewith (see Ellern, *Military and Civilian Pyrotechnics,* 1968, pages 201 to 203).

When the delays are longer than 0.8 s/mm of composition depth, these compositions no longer satisfy all of the requirements such compositions must today meet. These compositions, for example, no longer burn perfectly if they are exposed to temperatures of −50° C. or if they are subjected to mechanical stress such as vibration, impact, shock or rotation. Under these conditions a high percentage of ignition failures results.

OBJECTS OF THE INVENTION

It is an object of the present invention to improve the known delay compositions based on tungsten, barium chromate and potassium perchlorate, so that, even under extreme mechanical stress conditions and at very low temperatures, they will still burn completely.

Another object is to provide pyrotechnic delay compositions which produce a certain delay of at least 1.2 seconds per millimeter, even at a temperature of +71° C.

DESCRIPTION OF THE INVENTION

We have discovered that the above objects are achieved by delay compositions with delays in the range of seconds, which comprise a pyrotechnic mixture of powdered metallic tungsten, barium chromate and potassium perchlorate, and additionally contain barium hexafluorosilicate ($BaSiF_6$) or calcium fluoride, combined with pyrogenic silica.

When the known delay compositions based on tungsten/$BaCrO_4$/$KClO_4$ are modified in accordance with the present invention, they burn perfectly even if they are subjected to a rotation of up to 17,000 rpm. Even at a rotation of more than 17,000 rpm, a perfect burn can take place. The above-mentioned stresses can be applied even in the temperature range between −54° C. and +71° C., and a perfect burn within the desired delay period is assured. Said improvement is given either with the addition of hexafluorosilicate alone or with the addition of calcium fluoride and pyrogenic silica.

The terms pyrogenic silica means finely dispersed $SiO_2$ with specific a surface area of 100 to 500 $m^2/g$, preferably 200 to 400 $m^2/g$. The addition of only 0.0 to 0% by weight, based on the total weight of the mixture, together with the calcium fluoride suffices to achieve this effect. The pyrogenic silica acid also improves the action of $BaSiF_6$, where used in quantities between 0.1 to 5.0% by weight, based on the total weight of the composition. This combination gives extremely good improvements for special compositions.

The amount of added barium hexafluorosilicate ($BaSiF_6$) or calcium fluoride ($CaF_2$) may vary between 1 and 10% by weight, based on the total weight of the mixture. The barium hexafluorosilicate is preferably used in amounts between 2 and 6% by weight, and the calcium chloride is preferably used in amounts between 1 and 5% by weight, based on the total weight of the composition.

The delay compositions in accordance with the present invention can be used either in powder form on in bound form. Suitable binding agents to improve the free-flowing quality of the compositions are inorganic or organic cellulose esters, such as nitrocellulose, acetylcellulose or cellulose esters of lower alkanoic acids, for example, butyric or propionic acid, the latter optionally mixed with acetylcellulose. Their content in the delay composition is generally between 0.5 and 3% by weight.

The burn time of the delay composition in accordance with the present invention can be conventionally adjusted to between 0.1 and 2 seconds per millimeter, preferably to more than 0.8 s/mm, of composition depth by varying the component ratios.

The grain size of the powdered tungsten is generally less than 20 μm. By varying the grain size distribution, the burn time can also be adjusted within narrow ranges to any desired time. This adjustment can be effected especially by selecting two different grain size ranges, the percentage of the grain size range below 10 μm to amount to between 20 and 60% by weight of all of the tungsten powder; the rest of the , tungsten powder is then to have a grain size between 10 to 20 μm.

The composition of the instant invention is prepared in conventional manner. The unbound composition can be made by mixing the individual components simultaneously. If binding agents are used, they are dissolved or suspended in an appropriate solvent, such as acetone, and the rest of the components are dispersed in this solution or suspension. The dispersion thus obtained is then substantially freed from solvent, so that free-flowing grains are produced which are then compressed to form the desired delay composition.

The compositions according to the present invention are used as delayed action detonators and igniters and as ignition delaying means.

The following example illustrates the present invention and will enable others skilled in the art to understand it more completely. It should be understood, however, that the invention is not limited solely to the particular example given below.

EXAMPLE

The following were added, while stirring, to a solution of 2 parts by weight of nitrocellulose in 100 parts by weight of acetone:

24 parts by weight tungsten powder (grain size <20 μm)
64 parts by weight barium chromate
12 parts by weight potassium perchlorate
4 parts by weight barium hexafluorosilicate
2 parts by weight pyrogenic silica (Aerosil®).

After intensive mixing, the solvent was evaporated, and free-flowing grains were prepared by conventional methods. These were compressed in charges in successive layers to form a cylindrical body, each charge containing about 125 mg of composition, and the total composition depth was 10 mm.

The compressed delay composition ignited by a firing charge. The burn times were measured at the temperatures +71° C., 20° C. and −54° C., with and without rotation. The results are shown in the following table:

| Temperature [°C.] | Burn time [sec. per 10 mm of composition column] without rotation | with rotation (17,000 rpm) |
|---|---|---|
| +71 | 12.5 | 15.5 |
| +20 | 13 | 16 |
| −54 | 15 | 18.5 |

While the present invention has been illustrated with the aid of certain specific embodiments thereof, it will be readily apparent to others skilled in the art that the invention is not limited to these particular embodiments, and that various changes and modifications may be made without departing from the spirit of the invention or the scope of the appended claims.

We claim:

1. A pyrotechnic time delay composition with a delay period in the seconds range, comprising powdered metallic tungsten, barium chromate, potassium perchlorate and barium hexafluorosilicate.

2. A pyrotechnic time delay composition of claim 1, which comprises 1 to 10% by weight of barium hexafluorosilicate.

3. A pyrotechnic time delay composition of claim 1, wihch contains 0.1 to 5.0% by weight of pyrogenic silica.

4. A pyrotechnic time delay composition of claim 1, wherein the particle size of the powdered metallic tungsten is less than 20 micrometers, and 20 to 60% of the powdered tungsten has a particle size of less than 10 micrometers.

* * * * *

UNITED STATES PATENT AND TRADEMARK OFFICE

CERTIFICATE OF CORRECTION

PATENT NO. : 4,963,204

DATED : October 16, 1990

INVENTOR(S) : Günther Faber et al

It is certified that error appears in the above-identified patent and that said Letters Patent is hereby corrected as shown below:

Column 1, lines 63 to 64, "0.0 to 0%" should read --1.0 to 10%--.

Signed and Sealed this

Fourth Day of May, 1993

*Attest:*

Michael K. Kirk

MICHAEL K. KIRK

*Attesting Officer*

*Acting Commissioner of Patents and Trademarks*